US010434517B2

(12) United States Patent
Nied et al.

(10) Patent No.: US 10,434,517 B2
(45) Date of Patent: Oct. 8, 2019

(54) METHOD FOR JET MILLING AND JET MILL THEREFOR

(71) Applicants: NETZSCH Trockenmahltechnik GmbH, Selb (DE); Roland Nied, Bonstetten (DE)

(72) Inventors: Roland Nied, Bonstetten (DE); Hermann Sickel, Gambach/Muenzenberg (DE)

(73) Assignees: NETZSCH Trockenmahltechnik GmbH, Selb (DE); Roland Nied, Bonstetten (DE)

( * ) Notice: Subject to any disclaimer, the term of this patent is extended or adjusted under 35 U.S.C. 154(b) by 930 days.

(21) Appl. No.: 14/155,084

(22) Filed: Jan. 14, 2014

(65) Prior Publication Data

US 2014/0197252 A1 Jul. 17, 2014

(30) Foreign Application Priority Data

Jan. 14, 2013 (DE) ..... 10 2013 000 426

(51) Int. Cl.
*B02C 19/06* (2006.01)
*B02C 19/18* (2006.01)
*B02C 25/00* (2006.01)

(52) U.S. Cl.
CPC ..... *B02C 19/06* (2013.01); *B02C 19/186* (2013.01); *B02C 25/00* (2013.01)

(58) Field of Classification Search
CPC ..... B02C 19/06; B02C 19/186; B02C 19/066; B02C 19/068
USPC ..... 241/5, 15, 18, 23, 39, 41
See application file for complete search history.

(56) References Cited

U.S. PATENT DOCUMENTS 4,463,430 A * 7/1984 Volk, Jr. ..... A23N 17/005 137/2
5,716,751 A * 2/1998 Bertrand ..... G03G 9/0804 241/15
5,732,893 A * 3/1998 Nied ..... B02C 19/068 241/39
6,196,482 B1 * 3/2001 Goto ..... B02C 19/06 241/39

(Continued)

FOREIGN PATENT DOCUMENTS

EP 2024093 B1 5/2011

OTHER PUBLICATIONS

Preface and Introduction to Water and Steam Software; Wagner, W., et al. 2008; 6 pages.

*Primary Examiner* — Anthony D Stashick
*Assistant Examiner* — Onekki P Jolly
(74) *Attorney, Agent, or Firm* — Whitmyer IP Group LLC

(57) ABSTRACT

A method for jet milling of damp or wet grist in a jet mill, such that at least one of the operating parameters is appropriately selected so that a combined drying and milling process occurs in which, to obtain an end product with predetermined degree of fineness and moisture content. The specific operating mechanism required for milling is selected so that it is greater than or equal to the specific drying requirement, and the end product is released from the jet mill with the predetermined fineness and moisture content. In addition, the invention relates to a jet mill to perform this method, such that adjusting, controlling or regulating devices are foreseen for adjusting, controlling or regulating at least one of the operating parameters.

11 Claims, 2 Drawing Sheets

(56) References Cited

U.S. PATENT DOCUMENTS

| | | | | |
|---|---|---|---|---|
| 7,278,595 | B2 * | 10/2007 | Itoh | B02C 23/02 241/39 |
| 7,681,814 | B2 * | 3/2010 | Krebs | B02C 19/063 241/39 |
| 8,047,458 | B2 | 11/2011 | Nied et al. | |
| 2004/0211849 | A1 * | 10/2004 | Itoh | B02C 23/02 241/39 |
| 2009/0261187 | A1 * | 10/2009 | Nied | B02C 19/06 241/24.1 |
| 2010/0065668 | A1 * | 3/2010 | Nied | B02C 19/065 241/5 |
| 2010/0285317 | A1 * | 11/2010 | Meier | B02C 19/06 428/402 |
| 2011/0073689 | A1 * | 3/2011 | Paulat | B02C 19/06 241/15 |

* cited by examiner

METHOD FOR JET MILLING AND JET MILL THEREFOR

FIELD OF THE INVENTION

The present invention relates to a method for jet milling and to a jet mill therefor according to the claims.

BACKGROUND OF THE INVENTION

In many processes, a product that is to be milled is held in a wet suspension in a preliminary process (precipitation, flotation, washing). If the milled end product exists in dry form, the desired final moisture content is to be selected in a complex process, such as through mechanical pre-dewatering, for instance in filter presses, and then thermal drying. Milling to a required final degree of fineness, finally, is performed frequently in jet mills. Typical applications are, for example, the production of talcum, silicic acid, magnesium hydroxide or ceramic ink-jet pigments.

The disadvantage here is the total expenditure in equipment and time in order to obtain a millable product from a wet suspension eventually with a desired final moisture content and final degree of fineness.

SUMMARY OF THE INVENTION

It is the object of the present invention to simplify the existing method and to configure it in a more advantageous form.

This object is achieved with a method for jet milling and a jet mill according to the claims.

It is thus foreseen with the invention to conduct milling and drying in a common process step. The entire process can thereby be conducted substantially more simply and more reasonably in terms of energy.

In the inventive method for jet milling of damp or wet grist in a jet mill, damp or wet grist is fed into the jet mill for milling. At least one operating parameter (preliminary pressure, tension-reducing pressure and/or input temperature) in the jet mill is appropriately selected in such a way that combined drying and milling ensues. Here, to receive an end product with a predetermined final degree of fineness and final moisture content, the damp or wet grist is simultaneously milled by milling in the jet mill to the predetermined final degree of fineness and dried by drying to the predetermined final moisture content. In the process, by appropriate selection of the at least one operating parameter (preliminary pressure, tension-reducing pressure and/or input temperature), the specific operating material required for milling is selected in such a way that it is greater than or equal to the specific operating material required for drying. Finally, the end product is released from the jet mill with the predetermined final degree of fineness and the predetermined final moisture content.

Another advantageous option is to measure or monitor the actual final moisture content of the grist before it is released from the jet mill or the actual final moisture content of the end product. According to a preferred refinement thereof, it is also possible that the at least one operational parameter of the jet mill is appropriately adjusted, controlled or regulated once or repeatedly at time intervals or at least approximately continuously for the combined drying and milling, depending on the one hand on the actual final moisture content of the grist before it is released from the jet mill or of the actual final moisture content of the end product, and on the other hand on the predetermined final moisture content of the end product.

In an additional preferable configuration of the inventive method, gases or superheated steams come into use as operating means.

The invention further proposes a jet mill for jet milling of damp or wet grist into an end product, such that

- to adjust, control or regulate at least one of the operating parameters (preliminary pressure, tension-reducing pressure and/or input temperature), adjusting, control or regulating devices are provided in the jet mill, by means of which the at least one operating parameter (preliminary pressure, tension-reducing pressure and/or input temperature) is appropriately selected in the jet mill in such a way that combined drying and milling occurs, in which the damp or wet grist simultaneously is milled in the jet mill by milling to the predetermined final degree of fineness and is dried by drying to the predetermined final moisture content,
- the adjusting, controlling or regulating devices are configured in such a way that by appropriate selection of the at least one operating parameter (preliminary pressure, tension-reducing pressure and/or input temperature), the specific operating fuel requirement of the milling is selected in such a way that it is greater than or equal to the specific operating fuel requirement of drying, and
- the end product outlet of the jet mill is designed in such a way that the end product with the predetermined final degree of fineness and the predetermined final moisture content is released from the jet mill by the end product outlet.

Final moisture content ascertainment or monitoring devices are preferably linked to the end product outlet of the jet mill to ascertain or monitor the actual final moisture content of the grist before its release from the jet mill or the actual final moisture content of the end product, which is obtained by milling and drying of the grist in the jet mill.

In addition, it is preferable here to provide that the adjusting, controlling or regulating devices are configured in such a way that, by appropriate selection of the operating parameter or parameters (preliminary pressure, tension-reducing pressure and/or input temperature), the specific operating means required for milling is selected in such a way that it is greater than or equal to the specific operating means required for drying. It is further preferable here to provide that the adjusting, controlling or regulating devices are configured in such a way that the at least one operating parameter (preliminary pressure, tension-reducing pressure and/or input temperature) of the jet mill is appropriately adjusted, controlled or regulated once or repeatedly at time intervals or at least approximately continuously for the combined drying and milling, depending on the one hand on the actual final moisture content of the grist before its release from the jet mill or the actual final moisture content of the end product and on the other hand on the predetermined final moisture content of the end product.

An additional preferred configuration consists in the use of gases or superheated steams as operating means.

Preferred and/or advantageous configurations of the invention and of its individual aspects can be seen from the depending claims and their combinations as well as from the present application documents in their entirety.

BRIEF DESCRIPTION OF THE DRAWINGS

The invention is described in closer detail hereinafter with reference to embodiments and to the drawing, in a merely illustrative manner, in which.

DETAILED DESCRIPTION OF THE INVENTION

Figure 1:
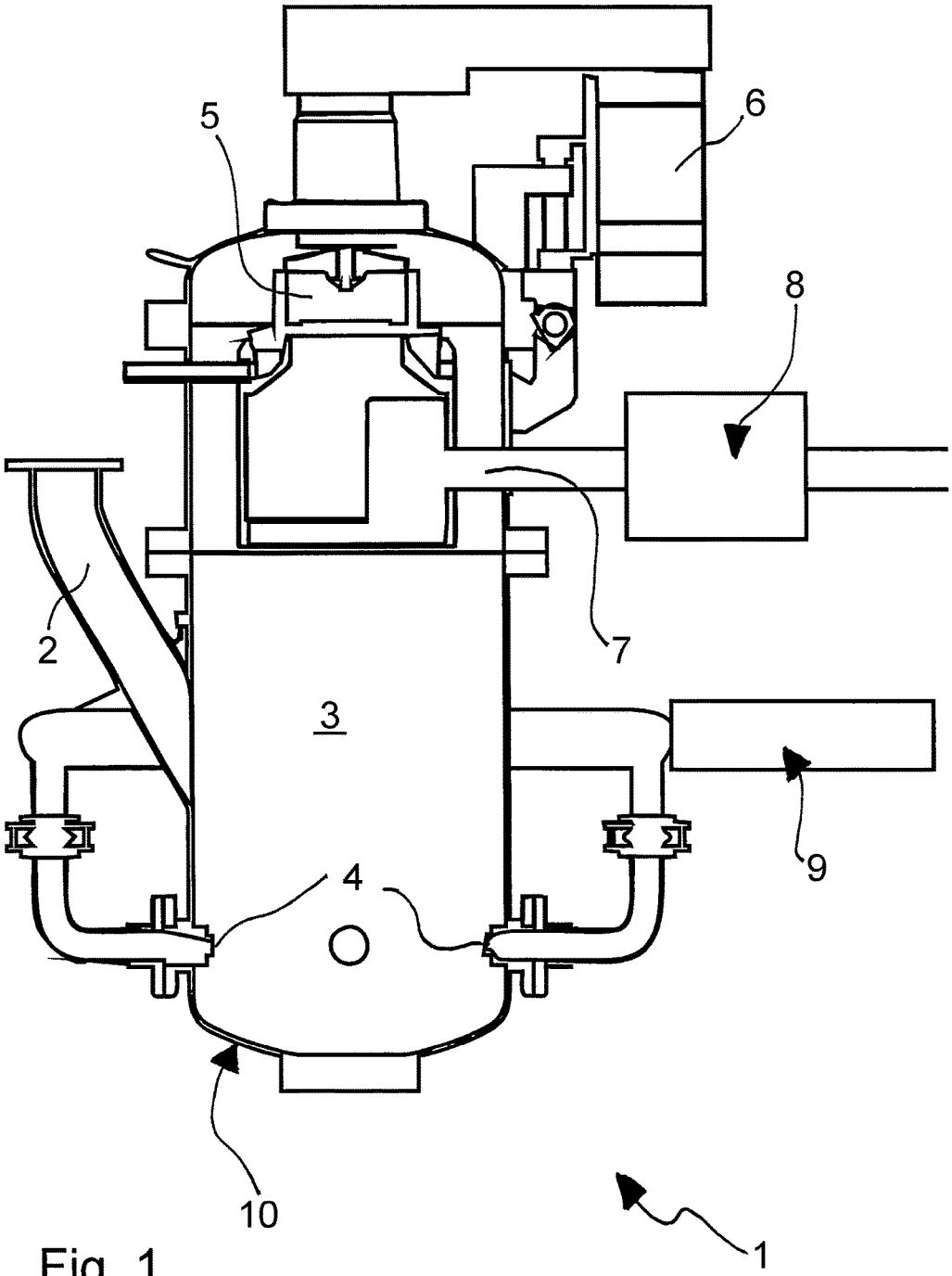
FIG. 1 shows in a schematic sectional view an embodiment of a fluidized-bed jet mill.

On the basis of the embodiments and application examples described hereinafter and illustrated in the drawings, the invention is described in greater detail, merely by way of example; that is, it is not restricted to these embodiments and application examples. Features of the method and the device can be seen in each case analogously from the descriptions of the apparatus and/or methods.

Individual features indicated and/or depicted in relation to a concrete embodiment are not restricted to this embodiment or to the combination with the other features of this embodiment, but rather can be combined in the context of technical possibilities with any other variants even when they are not separately discussed in the present documents.

Identical reference numbers in the individual figures and images of the drawings designate components that are the same or similar or that act in the same or similar manner. On the basis of the depictions in the drawing, other features are also made clear which are not provided with reference numbers, regardless of whether such features are described thereafter or not. On the other hand, features, which are contained in the present description but not visible or drawn in the illustration, are also readily understandable for a person skilled in the art.

In FIG. 1, a fluidized-bed jet mill 10 is shown, serving as an example of an embodiment for a jet mill 1 in general. A few essential and customary components of the fluidized-bed jet mill 10 are designated merely for the purpose of orientation: feeder supports 2 for damp or wet grist (not shown), milling zone 3, mill gas nozzles 4, classifying wheel 5, motor 6 and end product outlet 7.

The grist is conveyed to the fluidized-bed jet mill 10 via the supply nozzle 2 above the mill gas nozzles 4. In the milling zone 3, by means of the gas jets issuing out of the mill gas nozzles 4, preferably gases or superheated steams, a material fluidized bed (not shown) is formed from which the grist enters the gas jets, where it (or in more precise terms, the particles contained therein) is accelerated to high speeds. The accelerated particles encounter one another in the gas jets as well as in the center of the milling zone and thereby are fragmented. Mill gas, de-tensed and charged with particles of different sizes, rises in the center of the milling zone 3 up to the classifying wheel 5, which can be powered by the motor 6 whose speed is steplessly adjustable. The particles corresponding to the adjusted conditions end up in the end product outlet 7. Particles that are too rough/too large/too heavy are rejected by the classifying wheel 5 and fall back into the fluidized bed.

Linked to the end product outlet 7 are devices 8 for ascertaining or monitoring final moisture content, to ascertain or monitor the actual final moisture content of the grist before its release from the jet mill or the actual final moisture content of the end product, which is obtained by milling and drying the grist in the jet mill.

Adjusting, controlling or regulating devices 9 are provided to adjust, control or regulate at least one operating parameter of the fluidized-bed jet mill 10. By means of the adjusting, controlling or regulating devices 9, the at least one operating parameter of the fluidized-bed jet mill 10 can be appropriately selected in such a way that combined drying and milling occur. In the present documents and in the present invention, combined drying and milling refers to a process in which, to obtain an end product with predetermined final fineness and predetermined final moisture content, the damp or wet grist is simultaneously milled in the jet mill, for example the fluidized-bed jet mill 10, by milling to the predetermined final fineness and is dried by drying to the predetermined final moisture content.

Preliminary pressure, tension-relieving pressure or input temperature, in particular, are foreseen as the at least one operating parameter that is adjustable, controllable or regulatable by means of the adjusting, controlling or regulating devices 9. The adjusting, controlling or regulating devices 9 are preferably configured in such a way that, by appropriate choice of the operating parameter(s) (preliminary pressure, tension-relieving pressure and/or input temperature), the specific operating means required for milling is selected in such a way that it is greater than or equal to the specific operating means required for drying.

The end product outlet 7 of the fluidized-bed jet mill 10 is configured in such a way that the end product with the predetermined final degree of fineness and the predetermined final moisture content is released from the fluidized-bed jet mill 10 through the end product outlet 7.

Hereinafter, further details of the invention are described in greater detail.

Milling and drying in fact constitute two actually separate procedural operations.

Milling is characterized by adiabatic energy input. Adiabatic energy designates the energy that is released in the form of kinetic energy upon adiabatic expansion of pressurized gases or steam.

It can be computed for ideal gases by the equation $$E_{ad} = \frac{\kappa}{\kappa - 1} \cdot m \cdot R \cdot T_0 \cdot \left[1 - \left(\frac{p_1}{p_0}\right)^{\frac{\kappa-1}{\kappa}}\right]$$

where $\kappa$=isentropic exponent m=gas mass

R=gas constant $T_0$=gas input temperature $p_1$=tension-relieving pressure $p_0$=gas pressure before tension relief For steams, this energy is obtained for the case of isentropic tension relief from the h-s diagram as the enthalpy difference between the input and tension relief conditions, again depending on steam preliminary pressure, steam input temperature and tension-relieving pressure (see, for example, *Water and Steam*, Springer Verlag, Berlin—Heidelberg, 2000).

As can be recognized from equation 1 (analogously with steams), the adiabatic energy input is modified at constant operating material mass and at varying input temperature or changing pressure conditions.

The mass throughput of the product that is to be milled to a desired final degree of fineness is thereby modified as well. That is, the ratio of the grist mass and operating means mass (=specific operating means consumption in kg/kg) is variable depending on the appropriate selection of operating parameters. In a diagram, FIG. 2 graphically illustrates the specific operating means requirement depending on the milling fineness obtained for an operating means pressure of 8 bar (abs) and 4 bar (abs) with talcum serving as the grist example.

Figure 2:
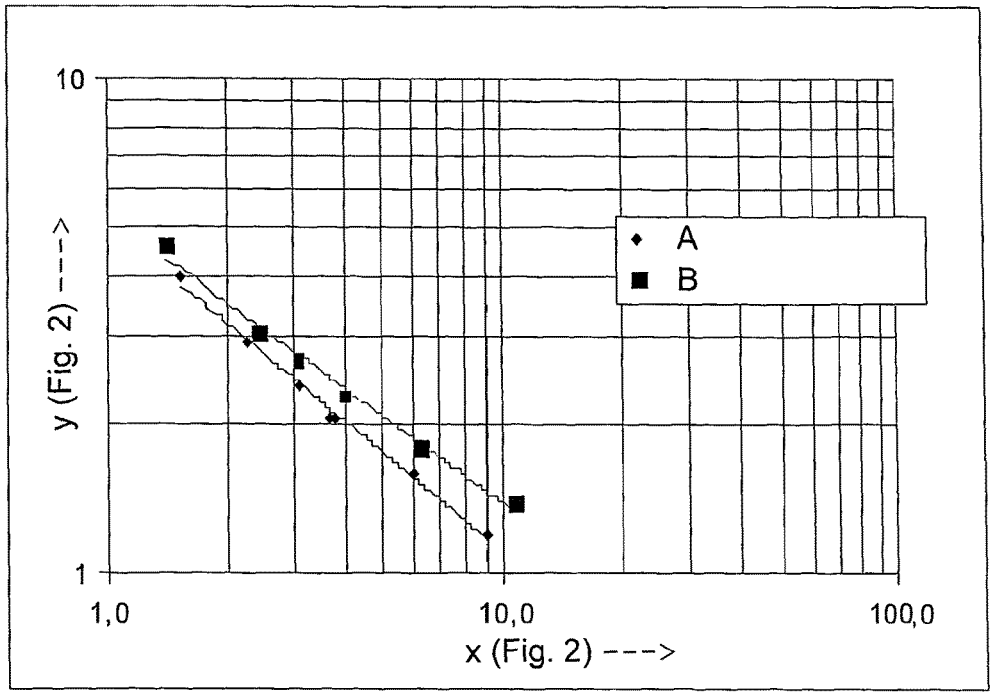
FIG. 2 shows in a graphical depiction the specific operating means required, depending on the achieved milled fineness for an operating means pressure of 8 bar (abs) and 4 bar (abs) with talcum as grist.

The concrete data in FIG. 2 are:

x (FIG. 2): specific air requirement [$m^3$/kg]

y (FIG. 2): d50 [③m]

A: air 8 bar (abs), 160° C.

B: air 4 bar (abs), 168° C.

Thermal energy is required for the drying process. It is composed of the energy for warming the moist input material to the output temperature and of the evaporation enthalpy of the liquid obtained:

$$Q=c_{p,solid}\cdot\Delta T+c_{p,liquid}\cdot\varphi\cdot\Delta T+h_{evaporation}\cdot\varphi \quad \text{(equation 2)}$$

where

Q=specific drying energy $c_p$=specific heat capacity $h_{evaporation}$=specific evaporation enthalpy ψ=relative liquid content ΔT=temperature difference, input/output The unit of specific energy thus computed is kJ/$kg_{solid}$.

This energy, as has now been recognized as a basis of the invention, is introduced by the operating means into the process:

$$E_{spec.oper.mater.} = \frac{E_{therm.oper.mater..}}{m_{oper.mater.}} = c_{p,operat.mater.}\cdot(T_{op.mater.,in}-T_{out}) \quad \text{(equation 3)}$$

Dividing the specific drying energy according to equation 2 by the thermal energy according to equation 3, one obtains the specific operating means requirement for the entire process:

$$\frac{m_{operat.,means}}{m_{product}} = \frac{Q}{E_{spec,operat.means}} \quad \text{(equation 4)}$$

Figure 3:
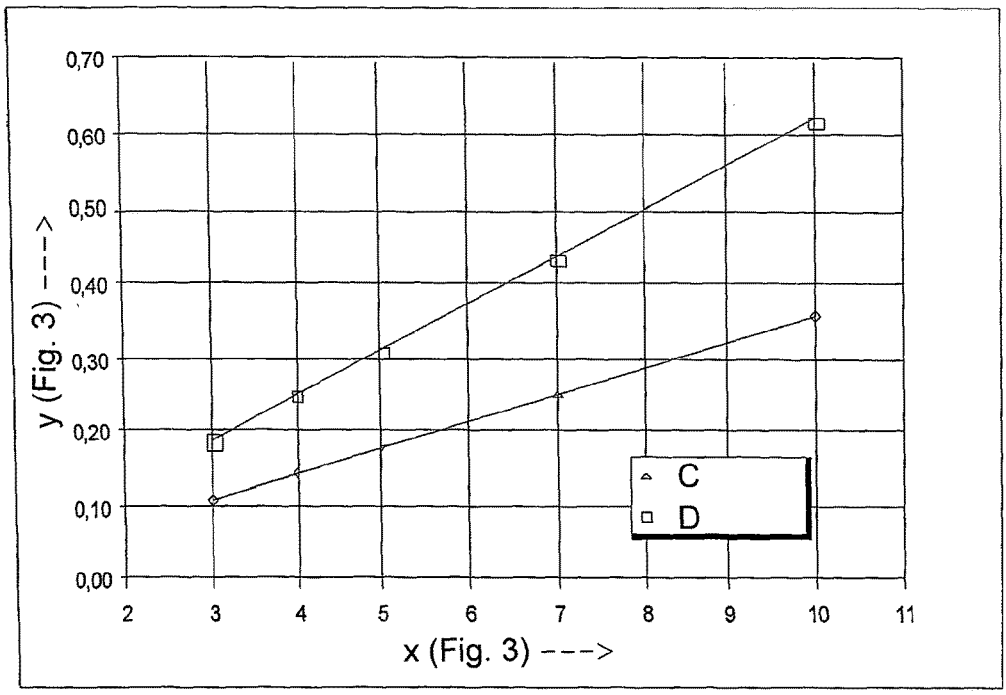
FIG. 3 shows in a graphical depiction the specific drying capacity depending on the specific operating means requirement (here: water steam).

In FIG. 3 the specific drying capacity is illustrated by way of example, depending on the specific operating means use (water steam at high heat).

The concrete data in FIG. 3 are:

x (FIG. 3): specific steam use mD, spec. [kg/kg]

y (FIG. 3): drying capacity [kgH2O/kgAG]

C: delta T=40°

D: delta T=70°

Use of the method is especially advantageous in connection with e-jet (low pressure, heated gas: see EP 2 024 093 B1 by the same inventor) or s-jet (water steam at high heat).

Accordingly, with the inventive method for jet milling of damp or wet grist in a jet mill 1, as for example in the fluidized-bed jet mill 10, it is foreseen that damp or wet grist to be milled in the jet mill is fed into the milling zone 3 through the feeder support 2, that at least one operating parameter of the jet mill 1 is appropriately selected by the adjusting, controlling or regulating devices 9 so that a combined drying and milling process occurs in which the damp or wet grist is simultaneously milled in the jet mill 1 by milling to the predetermined final degree of fineness and is dried by drying to the predetermined final moisture content to obtain an end product with a predetermined final degree of fineness and predetermined final moisture content, and finally that the end product with the predetermined final degree of fineness and the predetermined final moisture content is released out of the jet mill 1 through the end product outlet 7.

The preliminary pressure, tension-relieving pressure or input temperature is appropriately selected as the at least one operating parameter for drying and milling in the jet mill 1, in such a way that, by appropriate choice of the operating parameter or parameters (preliminary pressure, tension-relieving pressure and/or input temperature), the specific operating means required for milling is selected so that it is greater than or equal to the specific operating means required for drying.

In addition, it can be advantageously foreseen that the actual final moisture content of the grist before its release from the jet mill 1 or the actual final moisture content of the end product is measured or monitored, in particular with the devices 8 for ascertaining or monitoring final moisture content that are linked to the end product outlet 7, and that the at least one operating parameter of the jet mill 1 is appropriately adjusted, controlled or regulated, in particular by means of the adjusting, controlling or regulating devices 9, once or repeatedly at time intervals or at least approximately continuously for drying and milling, depending on the one hand on the actual final moisture content of the grist before its release from the jet mill or the actual final moisture content of the end product, and on the other hand on the predetermined final moisture content of the end product.

It is advantageous to use gases or superheated steams as operating means with the inventive jet mill.

The invention is described merely by way of examples with reference to the embodiments in the description and in the drawings and is not restricted to them, but rather includes all variations, modifications, substitutions and combinations which a person skilled in the art can see from the present documents, particularly in the context of the claims and the general comments in the introduction to this description as well as the description of the embodiments, and which he/she can combine with his/her skills and with knowledge of the art. In particular, all individual features and configuration possibilities can be combined with the invention.

What is claimed is:

1. A method for jet milling of wet grist in a jet mill, the method comprising:

introducing a grist into a jet mill when the grist is wet;

selecting at least one jet mill operating parameter, the at least one jet mill operating parameter including a preliminary pressure, a tension-reducing pressure, and/or an input temperature;

operating the jet mill at the selected at least one jet mill operating parameter to achieve a combined milling and drying of the grist and thereby obtain a grist end product with a predetermined final degree of fineness and a predetermined final moisture content; and releasing the grist end product with the predetermined final degree of fineness and the predetermined final moisture content from the jet mill.

2. The method of claim 1, further comprising measuring and monitoring an actual final moisture content of the grist end product before releasing the grist end product from the jet mill.

3. The method of claim 2, wherein the selecting step is performed once or repeatedly at time intervals or continuously during the operating step, depending on the actual final moisture content of the grist end product measured before release of the grist end product from the jet mill.

4. The method of claim 1, wherein an operating material of the jet mill is at least one of a gas and a superheated steam.

5. The jet method of claim 1, wherein a milling temperature is required for milling of the grist, and a drying temperature is required for drying of the grist;

wherein the drying temperature is greater than the milling temperature;

wherein the at least one jet mill operating parameter includes the input temperature, and the selecting step involves selecting the input temperature to be equal to or greater than the drying temperature.

6. The jet method of claim 1, wherein a milling preliminary pressure is required for milling of the grist, and a drying preliminary pressure is required for drying of the grist;

wherein the drying preliminary pressure is greater than the milling preliminary pressure;

wherein the at least one jet mill operating parameter includes the preliminary pressure, and the selecting step involves selecting the preliminary pressure to be equal to or greater than the drying preliminary pressure.

7. The jet method of claim 1, wherein a milling tension-reducing pressure is required for milling of the grist, and a drying tension-reducing pressure is required for drying of the grist;

wherein the drying tension-reducing pressure is greater than the milling tension-reducing pressure;

wherein the at least one jet mill operating parameter includes the tension-reducing pressure, and the selecting step involves selecting the tension-reducing pressure to be equal to or greater than the drying tension-reducing pressure.

8. A jet mill system, comprising:

a jet mill;

a feeder configured to permit introduction of a grist that is wet into the jet mill;

a selecting device configured to select at least one jet mill operating parameter, the at least one jet mill operating parameter including a preliminary pressure, a tension-reducing pressure, and/or an input temperature;

the jet mill configured to perform a combined milling and drying of the grist by operating at the selected at least one jet mill operating parameter to thereby obtain a grist end product with a predetermined final degree of fineness and a predetermined final moisture content; and an end product outlet configured to release the grist end product with the predetermined final degree of fineness and the predetermined final moisture content from the jet mill.

9. The jet mill system of claim 8, further comprising an ascertaining and/or monitoring device configured to ascertain and/or monitor a final moisture content, the ascertaining and/or monitoring device being linked to the end product outlet to ascertain and/or monitor an actual final moisture content of the grist end product before the grist end product is released from the jet mill.

10. The jet mill system of claim 9, wherein the selecting device is configured to select the at least one jet mill operating parameter once or repeatedly at time intervals or continuously during the combined milling and drying of the grist, depending on the actual final moisture content of the grist end product ascertained and/or monitored before the grist end product is released from the jet mill.

11. The jet mill system of claim 8, wherein an operating material of the jet mill is at least one of a gas and a superheated steam.

* * * * *